United States Patent [19]

Nalepa et al.

[11] B 3,993,603

[45] Nov. 23, 1976

[54] COMPOSITION FOR $VO_2$ INCANDESCENT LAMP CURRENT INRUSH LIMITERS

[75] Inventors: Philip J. Nalepa, Greensburg; Peter R. Emtage; Robert C. Miller, both of Pittsburgh, all of Pa.

[73] Assignee: Westinghouse Electric Corporation, Pittsburgh, Pa.

[22] Filed: June 10, 1975

[21] Appl. No.: 585,731

[44] Published under the second Trial Voluntary Protest Program on February 3, 1976 as document No. B 585,731.

[52] U.S. Cl. ..... 252/518; 106/39.5

[51] Int. Cl.[2] ..... H01B 1/08

[58] Field of Search ..... 252/518; 106/39.5

[56] References Cited

UNITED STATES PATENTS

| | | | |
|---|---|---|---|
| 3,402,131 | 9/1968 | Futaki et al. | 252/518 X |
| 3,557,026 | 1/1971 | Teeg et al. | 252/518 |

OTHER PUBLICATIONS

*Japanese Journal of Applied Physics*, vol. 8, No. 8, Aug. 1969.

*Primary Examiner*—Benjamin R. Padgett
*Assistant Examiner*—E. Suzanne Parr
*Attorney, Agent, or Firm*—W. D. Palmer

[57] ABSTRACT

An improved composition of $VO_2$ current inrush limiting ceramics for incandescent lamps using a 0.003–0.06 weight percent $MoO_3$ addition. This addition modifies the resistance-temperature relationship to provide a more gradual transition and also to provide a resistance which varies less at temperatures below the transition temperature. The more gradual change is desirable as it reduces the tendency for a delayed current overshoot and also reduces the tendency for the current to be funnelled through a relatively small portion of the thermistor. The more nearly constant low temperature resistance provides good current inrush limiting in a wider range of ambient temperatures.

2 Claims, 2 Drawing Figures

COMPOSITION FOR $VO_2$ INCANDESCENT LAMP CURRENT INRUSH LIMITERS

CROSS-REFERENCES TO RELATED APPLICATIONS

In copending application Ser. No. 525,414, filed Nov. 18, 1974 by D. R. Muss, which is a continuation of Ser. No. 339,491, filed Mar. 8, 1973, now abandoned, there is disclosed the use of a polycrystalline vanadium oxide (approximately $VO_2$) as a current inrush limiter for incandescent lamps. Refinements of this concept provided the first current inrush limiter which was effective in completely eliminating current overshoot and also highly efficient.

In copending application Ser. No. 585,732 filed concurrently with this application, by the same inventors, and assigned to the same assignee, there is disclosed the hot and cold resistance ranges and especially the thermistor mass to provide effective and efficient current inrush limiting. This copending application discusses a number of negative temperature coefficient thermistor material including vanadium dioxide and lanthanum cobalt oxide.

BACKGROUND OF THE INVENTION

This invention relates to inrush current limiters for incandescent lamp filaments and particularly to polycrystalline vanadium dioxide thermistors.

It has long been known that the large inrush currents typical of incandescent lamp filaments are detrimental and many suggestions of negative temperature coefficient thermistors have been made. The large inrush currents have detrimental effects both on the electrical systems supplying the power and on the lamps themselves. A number of detrimental effects on the lamp itself are known. These effects include, for example, the electromechanical effects of the large currents, but the most straightforward effect is probably the failure of the filament due to localized melting caused by local thermal overshoots which are in turn the result of the large inrush current. In this failure mode, a localized high resistance section is much more intensely heated due to its initial higher resistance. This effect is compounded as the positive temperature coefficient of the filament and the local heating combine to raise the resistance of the localized section more rapidly than the rest of the filament which results in even greater heating in the local section. Because the localized section heated up to its operating temperature much faster than the remainder of the filament and the total filament resistance has not risen to the operating value, the local section is subjected to higher than steady state operating currents even after the local section resistance has risen to or above its steady state operating value. This combination produces very intense local heating and temperatures even higher than the steady state operating temperature of that section. If a localized section reaches the melting point of the filament, the filament usually fails.

Despite the long-felt need, the thermistor configurations of the prior art have either failed to eliminate the inrush current overshoot or were excessively inefficient. Often the devices were both inefficient and ineffective. Several of the prior art devices, especially those with a very large thermistor mass or with a switching characteristic (as opposed to a more gradual change in resistance), delayed the current overshoot but did not eliminate it. While some of the configurations did extend the life of a lamp, this was primarily due to an excessive steady-state resistance in series with the filament which lowers the voltage across the filament and results in a very inefficient lamp with dramatically lower light output.

A very large number of negative temperature coefficient thermistor materials have been developed. Most thermistors (including undoped polycrystalline vanadium dioxide) have dramatically higher resistances at −20°C (which an outdoor lamp might be exposed to on a cold day) than at +25°C (a typical indoor ambient temperature). Thus a current limiter designed for indoor operation would take an extremely long time if used outdoor and thus be impractical for outdoor operation.

Futaki and Aoki (Japanese Journal of Applied Physics, Volume 8, No. 8, pages 1008–13, August 1969) have reported a number of various doping elements for vanadium oxide semiconductors. These elements include $MoO_3$ together with $P_2O_5$ in relatively large amounts (atom percents of 0.1 or more of $MoO_3$ and 1.0 of $P_2O_5/2$). While such relatively heavy doping does flatten the low temperature portion of the resistivity curve, such doping shifts the transition temperature down to about 55°–60°C which provides operating problems in high ambient temperatures and also reduces the cold-to-hot resistance ratio to a value of less than 20 and thus is completely unusable in a practical limiter configuration.

SUMMARY OF THE INVENTION

It has been discovered that a very small addition of $MoO_3$ (about 0.003–0.06 weight percent) results in very desirable modification to the resistance-temperature characteristic of a polycrystalline vanadium dioxide, when such a ceramic is electrically connected in series with an incandescible lamp filament for use in current inrush limiting. This molybdenum oxide addition results in a more gradual transition from the relatively higher resistance (low temperature) state to the relatively low resistance (high temperature) state and also provides a resistance which varies less with temperature at temperatures below the transition temperature.

BRIEF DESCRIPTION OF THE DRAWINGS

The invention can be best understood by reference to the following in which.

DESCRIPTION OF THE PREFERRED EMBODIMENTS

Efficient and effective current inrush limiting in a practical sense is obtained when the current overshoot is completely eliminated (and thus the thermal overshoot is completely eliminated) and the steady state power consumption of the limiter is less than 1% of the total power. Vanadium dioxide, when appropriately sized, provides such a practical limiter. It should be noted that what is referred to herein as a $VO_2$ limiter is not pure $VO_2$ and while such a limiter is principally $VO_2$, it can contain either $V_2O_3$ or $V_2O_5$ or both such that its composite formula is $V_2O_x$ where $x$ is less than 4.5 and greater than 3.5. The ceramic is polycrystalline vanadium oxide and also includes a glass phase, commonly $P_2O_5$, BaO and some vanadium oxide in the range of approximately 17–23% of the total thermistor weight.

Generally, the steady state operating resistance of the limiter should be less than about 1% of the hot resistance of the filament. This allows a standard 40 watt bulb, for example, (with a slight redesign for a slightly higher filament operating temperature) to have not only a greater than normal light output but also an increased life in normal operation. The lower the steady state operating resistance of the limiter, the more efficient the circuit arrangement can be, and typically the vanadium dioxide current limiters provide a resistance of less than one-half of 1% of the hot resistance of the filament.

Figure 1:
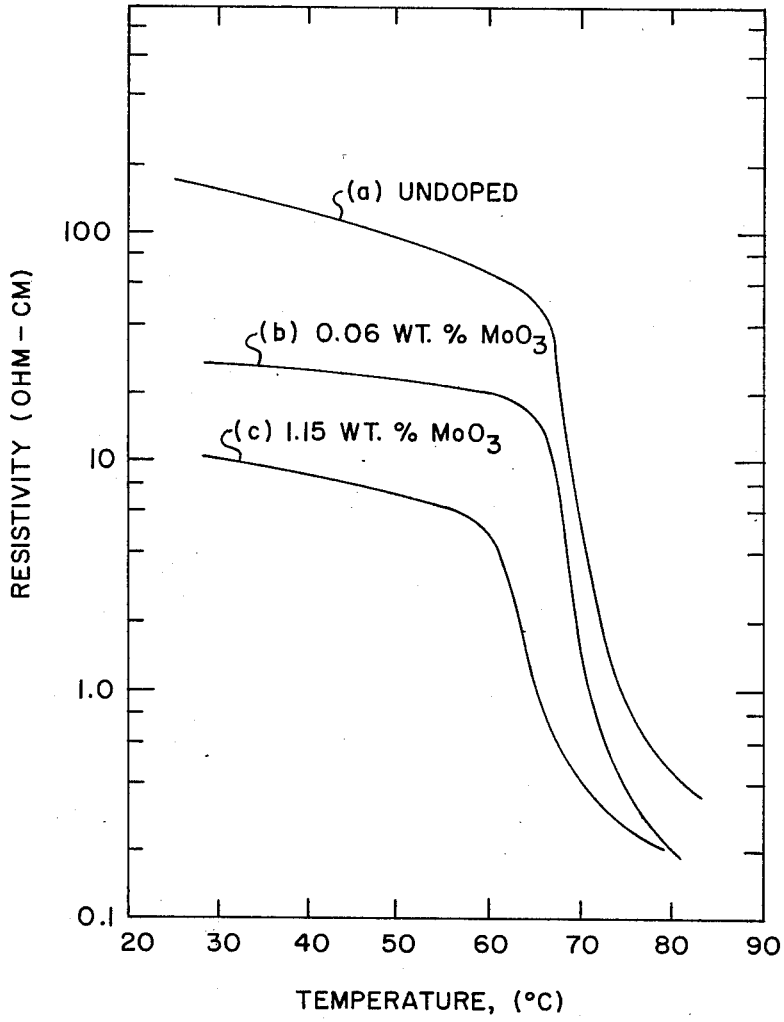
FIG. 1 is a graph showing the variation of electrical resistance with temperature of polycrystalline vanadium dioxide without molybdenum oxide doping and also with two different levels of molybdenum oxide doping.

FIG. 1 shows the resistivity versus temperature (a) for undoped polycrystalline vanadium dioxide, (b) for polycrystalline vanadium dioxide doped with about 0.06% by weight $MoO_3$, and (c) for polycrystalline vanadium dioxide doped with about 1.15 weight percent $MoO_3$. It can be seen that the undoped vanadium oxide goes through a large resistance change in changing from 25°C to the operating temperature of about 70°–80°C. The undoped vanadium dioxide, however, has a relatively high slope at temperatures below the transition temperature and therefore its current limiting action is quite dependent on the ambient temperature. It will also be noted that a portion of the curve in the transition region is nearly vertical.

This rapid resistance change also has a tendency to cause funnelling of the current through a small portion of the thermistor. The current funnelling or thermal filament effect results from the negative temperature coefficient of the thermistor material and localized heating. If the current is concentrated significantly more heavily in one portion of the thermistor, this causes local heating which drops the resistivity of that portion and this leads to an even greater concentration of current. When this occurs, only a relatively small portion of the thermistor material needs to be heated and a rather abrupt change with a switching characteristic (as if a switch were closed, shorting out the thermistor resistance) and a current overshoot is likely to occur. While other factors can also lead to the thermal filaments (such as inhomogenities or voids), the steep resistivity versus temperature curve is believed to be a very significant factor.

The curve of 0.06 weight percent $MoO_3$ has a lower slope in the temperature range below the transition temperature (the "transition temperature" is actually a temperature range, and is the range in which the resistivity is changing quite rapidly and the material is going through a transition between crystal phases). In addition the resistance change through the transition range is more gradual (having no extremely steep portion as in the undoped vanadium dioxide). Although some change in resistivity is sacrificed in this doped material, sufficient change still remains for an efficient limiter.

Although the change in resistance through the transition range is even more gradual for the 1.15 weight percent $MoO_3$ material (approximately 0.66 atom percent), this material does not have sufficient change in resistivity from room temperature to the 70°–80°C operating temperature typical of a limiter in a lamp base, and this material is unsuitable for such applications.

While the $MoO_3$ can be incorporated into the limiter in a number of manners, it has been found convenient to incorporate the $MoO_3$ into $V_2O_5$ by ball milling. The doped $V_2O_5$ is then blended with undoped $V_2O_3$ and binder glass. The blend is ball milled, pressed, and then sintered in an inert atmosphere furnace. The resultant thermistor is primarily $VO_2$, but the difficulties of producing $VO_2$ in powdered form are circumvented.

The $V_2O_3$ can be produced by hydrogen reduction of ammonium metavanadate at temperatures of 425°–600°C. The $V_2O_5$ powder is available commercially. The binder glass frit can be prepared by melting and quenching a mixture of $H_3PO_4$, $BaCO_3$ and $V_2O_5$ and ball milling the resultant glass to produce a fine powder. The $V_2O_3$ and doped $V_2O_5$ can be mixed in approximately equal molar amounts and mixed with the glass frit where the frit provides about 17½ weight percent of the total. Thus a typical mix might have 62.03 grams of $V_2O_3$, 84.13 grams of $V_2O_5$, 0.04268 grams of $MoO_3$, 13.89 grams of $P_2O_5$ and 5.266 grams of BaO. This provides a polycrystalline ceramic which is principally vanadium dioxide and is doped with about 0.03 weight percent $MoO_3$.

A mixture to provide about 0.06% doped vanadium dioxide can, for example, consist of 100.1 grams of $V_2O_3$, 121.5 grams of doped $V_2O_5$ (containing 1.215 grams of $MoO_3$) which was mixed with a binder prepared from 50.50 grams of 86% $H_3PO_4$ solution, 14.58 grams of $BaCO_3$, and 20.15 grams of doped $V_2O_5$ (containing 0.2015 grams of $MoO_3$).

An alternate mixture can also be used wherein nonmolar ratios of $V_2O_3$ and $V_2O_5$ ($V_2O_3/V_2O_5$ ratios of 1½:1 to 2:1 can be used) and an organic lubricant (for example the commercially available Carbowax) is used to facilitate pressing.

Limiters were made from each of the foregoing mixes using approximately 1.5 gram of limiter material, pressed at 10,000 psi in a rectangular die (approximately 3 millimeters by 4 millimeters by 14 millimeters long) and sintered in a furnace at about 950°–1100°C in an inert atmosphere. The material which contained the organic lubricant was prefired at about 300°C for about 30 minutes in air to vaporize the lubricant.

It has been found that approximately 0.003% of $MoO_3$ is necessary to provide a significant change from the properties of undoped vanadium dioxide and approximately 0.03 weight percent $MoO_3$ is preferred as being the best compromise, giving both the desired flattening of the low temperature resistivity curve and still giving sufficient change in cold-to-hot resistivity.

Figure 2:
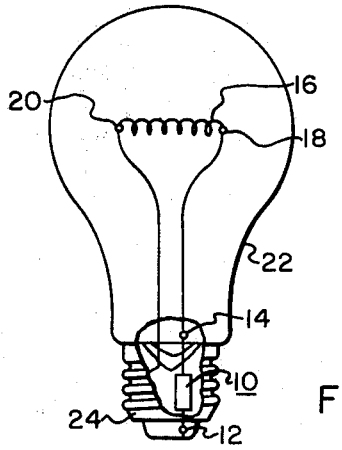
FIG. 2 shows an incandescent lamp having a molybdenum oxide doped, vanadium dioxide current inrush limiter in electrical series relationship with an incandescible lamp filament with the limiter contained within the base of the lamp.

FIG. 2 shows the preferred configuration for the doped vanadium dioxide current limiter where the incandescent lamp has a screw-type base and the thermistor is located in the base. Such a location is convenient in that it avoids the problems of locating a thermistor within the lamp envelope and being part of the lamp assures that the thermistor is properly sized for the particular sized filament (generally a thermistor is appropriate only for one wattage of lamp and thermistors which fit into a lamp socket can easily be used on the wrong wattage lamp). The thermistor 10 has a first terminal 12 and a second terminal 14 and is electrically connected in series with an incandescible lamp filament 16. The incandescible lamp filament 16 has a first terminal 18 and a second terminal 20. The second thermistor terminal 14 is electrically connected to the first filament terminal 18 and the first thermistor terminal 12 and the second filament terminal 20 are adapted to be individually electrically connected to a power source. The filament 16 is located within the light transmitting envelope 22. The thermistor 10 is located outside the light transmitting enveloe 22 but inside the screw-type base 24.

There are, of course, a number of alternative configurations that can be used. The thermistor could be located either inside the envelope or completely separately from the lamp. A resistor parallel to the thermistor as taught in the aforementioned concurrently filed application could also be used.

What we claim is:

1. An improved composition of vanadium oxide current inrush limiting ceramic for incandescent lamps, said ceramic being of the type electrically connected in series with an incandescible lamp filament and comprising vanadium oxide having a composite formula $V_2O_x$, where $x$ is less than 4.5 and greater than 3.5; wherein said improvement comprises doping said ceramic with 0.003–0.06 weight percent of $MoO_3$.

2. The composition of claim 1, wherein said ceramic is doped with about 0.03 weight percent of $MoO_3$.

* * * * *